United States Patent [19]

Ikejima

[11] Patent Number: 4,719,995

[45] Date of Patent: Jan. 19, 1988

[54] CONTROL APPARATUS FOR A.C. ELEVATOR

[75] Inventor: Hiroyuki Ikejima, Inazawa City, Japan

[73] Assignee: Mitsubishi Denki Kabushiki Kaisha, Japan

[21] Appl. No.: 46,390

[22] Filed: May 6, 1987

[30] Foreign Application Priority Data

May 8, 1986 [JP] Japan ..... 61-105557

[51] Int. Cl.[4] ..... B66B 1/30

[52] U.S. Cl. ..... 187/119; 318/806

[58] Field of Search ..... 187/119; 318/798–801, 318/806

[56] References Cited

U.S. PATENT DOCUMENTS 4,327,313 4/1982 Tsuboi et al. ..... 318/806 X
4,483,419 11/1984 Salihi et al. ..... 187/119
4,533,862 8/1985 Salihi ..... 187/119 X
4,600,088 7/1986 Yonemoto ..... 187/119
4,602,701 7/1986 Tanahashi ..... 187/119
4,625,834 12/1986 Tanahashi ..... 187/119

FOREIGN PATENT DOCUMENTS 59-7679 1/1984 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A control apparatus for an A.C. elevator having a variable voltage and variable frequency inverter for driving an induction motor coupled to a cage of the elevator, a control device for controlling the inverter in accordance with a deviation between a speed signal detected from the induction motor and a speed command signal having a preset value, and an abnormality detection device for interrupting feed of the A.C. power to the induction motor upon detecting that a slip frequency command corresponding to the deviation is greater than a predetermined set value and continues exceeding the predetermined set value in excess of a predetermined period of time.

8 Claims, 6 Drawing Figures

CONTROL APPARATUS FOR A.C. ELEVATOR

BACKGROUND OF THE INVENTION

This invention relates to a control apparatus for an A.C. elevator which controls the elevator that is driven by an induction motor.

FIGS. 4 and 5 are connection diagrams of such a prior-art control apparatus for an A.C. elevator as disclosed in Japanese patent application Laid-open No. 59-7679. Referring to FIG. 4, the control apparatus includes a three-phase A.C. power source 1, a converter 2 which is composed of diodes or thyristors, a smoothing capacitor 3 which is connected on the D.C. side of the converter 2 to smooth the D.C. power thereof, an inverter 4 which inverts the D.C. output of the smoothing capacitor 3 into A.C. power, a three-phase induction motor 5 which is driven by the A.C. power of the inverter 4, a brake wheel 6 which is mechanically coupled to the three-phase induction motor 5, and a brake shoe 7 which is disposed in opposition to the side peripheral surface of the brake wheel 6 and which applies a braking force to the brake wheel 6 by virtue of the force of a spring 8. A brake coil 9 draws the energized brake shoe 7 away from the brake wheel 6 against the force of the spring 8, and a D.C. power source 10 supplies D.C. power to the brake coil 9. The brake wheel 6 and the D.C. power source 10 mentioned above shall hereinbelow be simply called the "brake."

A driving sheave 11 is coupled to the three-phase induction motor 5 through the brake wheel 6 and is hoisted by the drive of the motor, while a main rope 12 is wound round the driving sheave 11 and has a cage 13 and a counterweight 14 coupled to both its ends. A tachometer generator 15 is directly coupled to the three-phase induction motor 5, and generates a speed signal Va expressive of the revolution speed of the motor. A control device 17 generates ignition signals 17*a*–17*f* for subjecting the output of the inverter 4 to a variable-voltage variable-frequency control, namely, for controlling the voltage and frequency thereof, on the basis of a speed command signal Vc and the speed signal Va. An abnormality detection device 18 detects the abnormality of the control device 17 on the basis of the speed signal Va and the speed command signal Vc. An abnormality detecting relay 19 has a normally-open contact 19*a*, and it is in an energized state during normalcy and is brought into a deenergized state by the abnormality detection signal of the abnormality detection device 18.

Referring to FIG. 5, a braking electromagnetic contactor 21 has one end connected to the plus (+) terminal of the power source through the normally-open contact 19*a* as well as a start command relay contact 22 which is closed by a start command delivered from an elevator controller not shown, while it has the other end connected to the minus-terminal of the power source. The contractor 21 further has a contact 21*a* which is connected between the brake coil 9 and the D.C. power source 10 shown in FIG. 4. Likewise to the braking electromagnetic contactor 21, an operating electromagnetic contactor 23 has one end connected to the plus + terminal of the power source through the normally-open contact 19*a* as well as another start command relay contact 22, while it has the other end connected to the minus-terminal of the power source. It has a normally-open contact 23*a* which is connected between the three-phase A.C. power source 1 and the converter 2.

FIG. 6 is a block diagram of the control device 17. Referring to the figure, an adder 17*g* evaluates the deviation (signal) between the speed command signal Vc and the actual speed signal Va. A speed controller 17*h* corrects the deviation from the adder 17*g*, and provides a slip frequency command 17*i* equivalent to a torque command. A voltage command generator 17*j* receives the slip frequency command 17*i* and the speed signal Va, and generates an A.C. voltage command. A pulse width modulator 17*k* generates the controlled ignition signals 17*a*–17*f* in accordance with the A.C. voltage command received from the voltage command generator 17*j*, and applies these ignition signals 17*a*–17*f* to the inverter 4 so as to subject it to the variable-voltage variable-frequency control.

Next, the operation of the prior-art apparatus will be described. During the stop of the cage 13, the brake shoe 7 is kept depressed on the brake wheel 6 by the force of the spring 8. Meanwhile, the abnormality detection device 18 holds the abnormality detecting relay 19 in the energized state to close the normally-open contact 19*a* when the deviation between the speed command signal Vc and the speed signal Va does not exceed a preset value, that is, when the control device 17 is not abnormal. In addition, when the start command of the cage 13 has been issued, the start command relay contact 22 is closed, and hence, the operating electromagnetic contactor 23 is energized to close the normally-open contact 23*a* thereof. Accordingly, the three-phase A.C. power is fed to the converter 2 through the normally-open contact 23*a*, and the converter 2 starts the delivery of the D.C. power. In response to the D.C. power, the inverter 4 supplies the three-phase induction motor 5 with the three-phase A.C. power of variable voltage and variable frequency which correspond to the rotating direction of the three-phase induction motor 5.

Since the start command relay contact 22 is closed by the start command of the cage 13, the braking electromagnetic contactor 21 is energized to close the contact 21*a* thereof. Accordingly, the brake coil 9 is energized by the D.C. power source 10, the brake shoe 7 is drawn away from the brake shoe 6, and the brake is released. Therefore, the three-phase induction motor 5 starts rotating in accordance with the three-phase A.C. power supplied from the inverter 4 and runs the cage 13.

The rotating speed of the three-phase induction motor 5 is detected and turned into the speed signal Va by the tachometer generator 15. Therefore, the control device 17 controls the ignition signals 17*a*–17*f* in accordance with this speed signal Va and the speed command signal Vc, thereby to control the voltage and frequency of the three-phase A.C. power from the inverter 4 toward the three-phase induction motor 5. That is, the control device 17 controls the rotating speed of the three-phase induction motor 5, accordingly the running speed of the cage 13, into a value corresponding to the speed command signal Vc. When the cage 13 has approached a floor to stop on, owing to the running thereof, the control device 17 begins a deceleration control, through which the cage is stopped at the position of the floor. Under this state, the start command relay contact 22 is opened, and the operating electromagnetic contactor 23 is deenergized, so that the normally-open contact 23*a* is opened. Also, the braking electromagnetic contactor 21 is deenergized, the contact 21a thereof is opened, and the brake coil 9 is deenergized. Finally, the brake shoe 7 is depressed on the brake wheel 6, and the cage 13 is stopped.

If, due to any abnormality, the deviation between the speed command signal Vc and the speed signal Va has become greater than the preset value after the issue of the start command of the cage 13, the abnormality detection device 18 produces the abnormality detection signal to deenergize the abnormality detecting relay 19 and to open the normally-open contact 19a thereof. Accordingly, the inverter 4 ceases the supply of the three-phase A.C. power to the three-phase induction motor 5. Moreover, since the brake coil 9 is deenergized in a sequence reverse to the foregoing, the brake shoe 7 frictionally brakes the brake wheel 6 so as to stop the cage 13.

The prior-art control apparatus for an A.C. elevator is constructed and operated as described above. Therefore, in a case where, in the state in which the brake shoe is depressed on the brake wheel by a cause such as the strong exertion of the spring 8 or the disconnection of the brake coil at the start of the cage or during the running thereof, the cage is operated downwards with a load near a rated carrying capacity or is operated upwards with no load, it can occur that the deviation between the speed command signal and the speed signal becomes smaller than the preset value for the abnormality detection and that the abnormality detection device fails to respond, and this poses the problem that a situation dangerous as the elevator arises. In such a case, the cage runs with the brake shoe actuated, so that a brake lining mounted on the brake shoe is heated and abraded until the braking function of the brake shoe degrades at last.

The cause by which the abnormality detection device fails to respond in the running mode of the cage, is as follows: In the case of the above operating mode performed with the brake released, a torque required for the acceleration of the induction motor is small. Therefore, even in the state in which the brake works, the induction motor can develop a torque required for executing the above operation, and the deviation between the speed command signal and the speed signal does not become large enough to actuate the abnormality detection.

SUMMARY OF THE INVENTION

This invention has been made in order to eliminate the problems as stated above, and has for its object to provide a control apparatus for an A.C. elevator which can improve the safety of the elevator.

The control apparatus for an A.C. elevator according to this invention includes a control device which controls an inverter in accordance with the deviation between a speed signal from an induction motor driven by A.C. power of variable voltage and variable frequency fed from the inverter and a speed command signal having a preset value, in that an abnormality detection device interrupts the feed of the A.C. power to the induction motor upon detecting the fact that a slip frequency command corresponding to the deviation is in a state in which it is greater than a predetermined set value and the fact that the state continues in excess of a predetermined period of time.

With the abnormality detection device in this invention, upon detecting that the state in which the frequency command corresponding to the deviation between the actual speed signal and the preset speed command signal is greater than a predetermined set value continues in excess of a predetermined time, the feed of the A.C. power to the induction motor is interrupted, so that a cage can be stopped safely.

BRIEF DESCRIPTION OF THE DRAWINGS

Throughout the drawings, the same symbols indicate identical or corresponding portions.

DESCRIPTION OF THE PREFERRED EMBODIMENT

Figure 1:
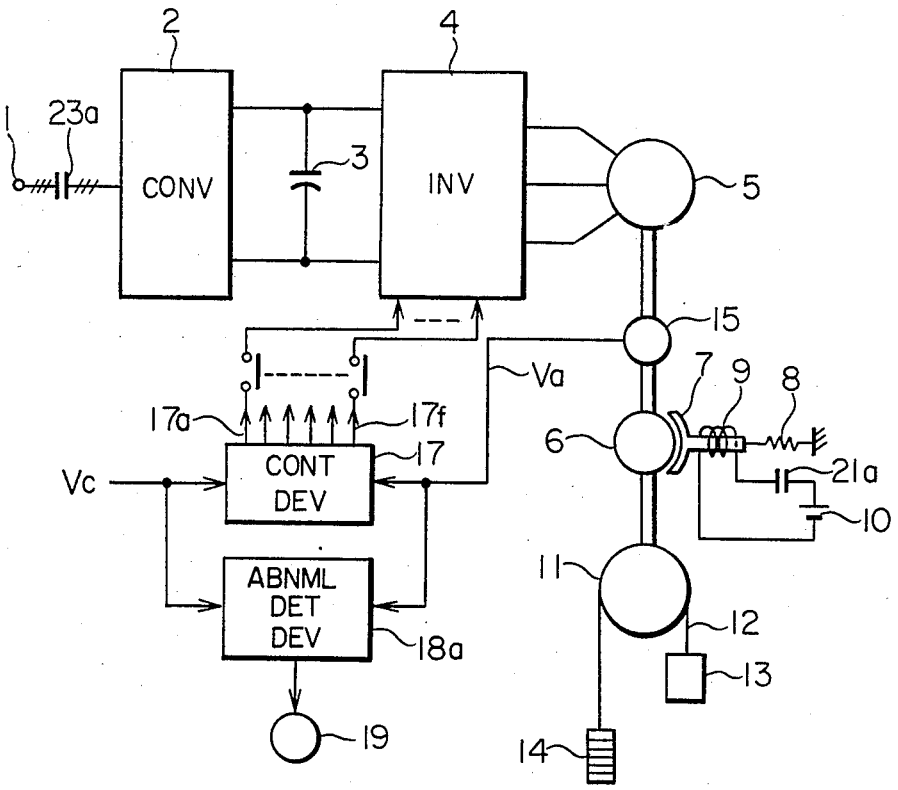
FIGS. 1 and 2 are connection diagrams which show a control apparatus for an A.C. elevator according to an embodiment of this invention.
Figure 2:
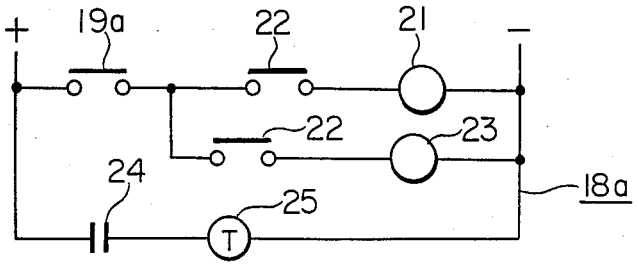

Now, an embodiment of this invention will be described with reference to the drawings. In FIG. 1, symbol 18a denotes an abnormality detection device which has an arrangement as shown in FIG. 2. Referring to FIG. 2, a contact 24 (the control line of which is not shown) is controlled by a slip frequency command 17i so as to close when the slip frequency command 17i of a speed controller 17h equivalent to the torque command of a motor 5 has exceeded a predetermined value. A time limit relay 25 is connected in series with the contact 24. When the contact 24 is kept closed in excess of a time of T seconds, the relay 25 is energized to deenergize an abnormality detecting relay 19. Herein the time T is set in correspondence with a nominal time in which a cage 13 reaches a fixed speed after the start thereof.

Figure 4:
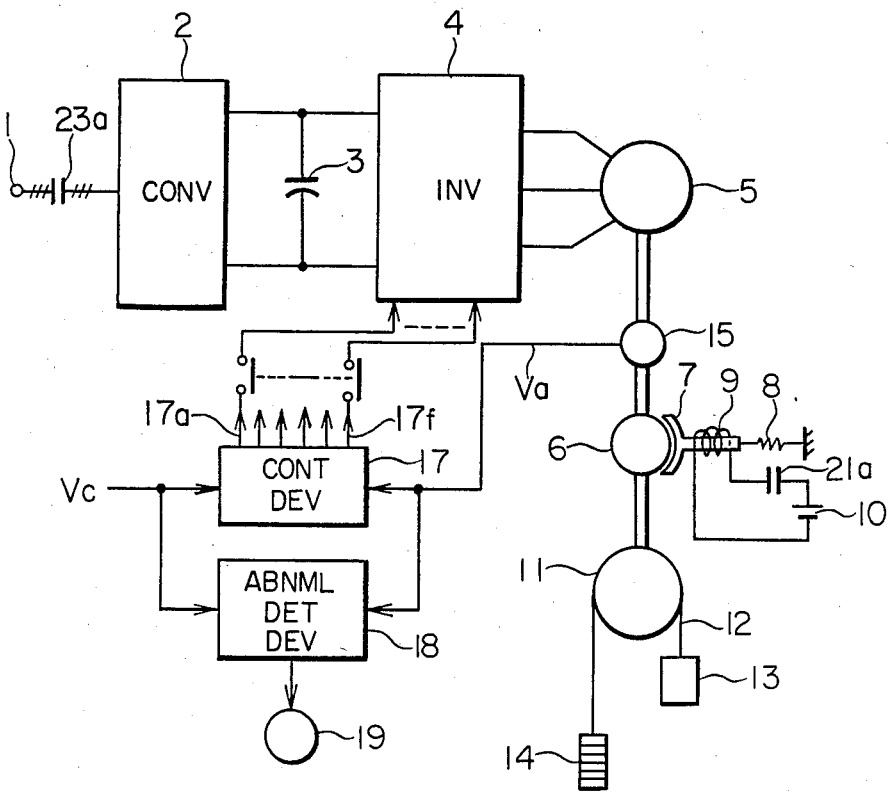
FIG. 4 (PRIOR ART)
FIGS. 4, 5 and 6 are connection diagrams which show a prior-art control apparatus for an A.C. elevator.
Figure 5:
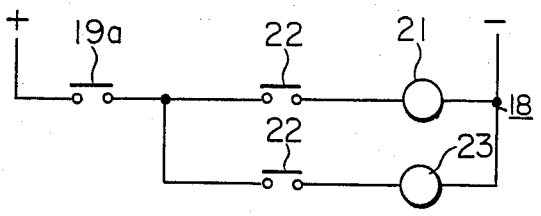
FIG. 5 (PRIOR ART)
Figure 6:
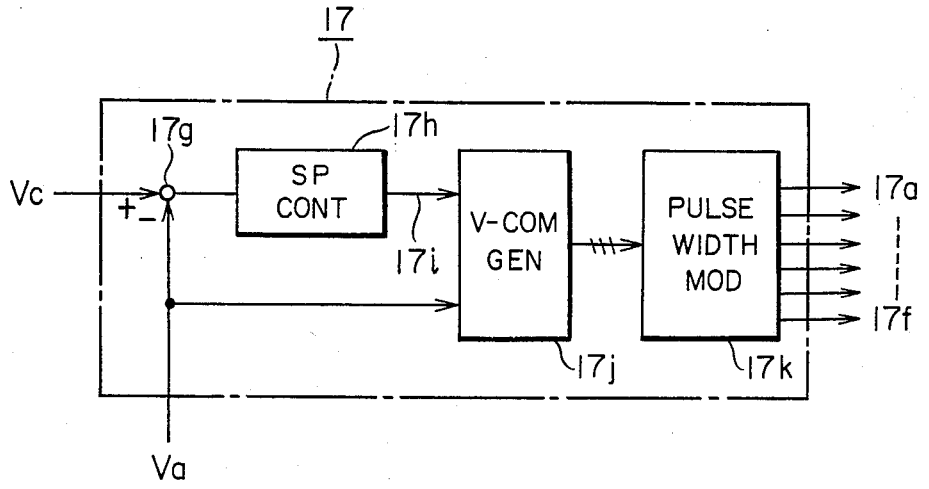

Here, in a case where the brake shoe 7 is not energized, a torque required by the cage 13 under the state of the fixed speed is usually greater than a torque which is developed under the state of the permissible overload carrying capacity of the elevator and the fixed speed when a brake wheel 6—a D.C. power source 10, namely, a brake function(s) normally. Accordingly, the predetermined value of a torque required for detecting the dragging of the brake, in other words, the slip frequency command 17i at the closure of the contact 24 is set to be greater than the value of the slip frequency command 17i which is given when the cage is running with the overload carrying capacity and at the fixed speed in the up direction. Besides, in FIGS. 1 and 2, portions with the same symbols as in FIGS. 4 thru 6 already explained are identical or corresponding portions, as to which reference shall be had to the foregoing.

The control apparatus for an A.C. elevator according to the present invention constructed as thus far described operates as follows:

Even if the contact 24 is closed by the control device 17 during the acceleration of the cage 13, it is opened when the acceleration is ended at the fixed speed, because the slip frequency command 17i becomes smaller than the predetermined value. Accordingly, the time limit relay 25 is not energized. However, in a case where the brake shoe 7 is not drawn away due to any cause and when the cage 13 has started under this condition, the slip frequency command 17i becomes greater than the predetermined set value, and this state continues longer than the period of time T in which the cage 13 reaches the fixed speed after the beginning of the acceleration, so that the time limit relay 25 is energized. Thus, the time limit relay 25 deenergizes the abnormality detecting relay 19. Thenceforth, as stated before, the normally-open contact 23*a* is opened by the functions of the normally-open contact 19*a*, start command relay contact 22 and operating electromagnetic contactor 23, and the three-phase A.C. power from the three-phase A.C. power source 1 is cut off.

Figure 3:
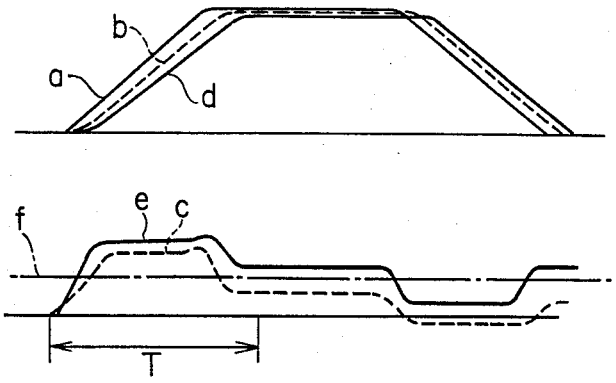
FIG. 3 is a waveform diagram for explaining the operation of the control apparatus for an A.C. elevator shown in FIG. 1.

FIG. 3 is a waveform diagram showing the operation of the abnormality detection device 18*a*. In the figure, letter a denotes the speed command signal Vc, letter b the actual speed signal Va in the case where the brake functions normally when the cage ascends with the overload carrying capacity, letter c the slip frequency command 17*i* corresponding to the situation b, letter d the actual speed signal Va in the case where the brake does not begin to work at the time of the start of the cage when the cage ascends with no load, letter e the slip frequency command 17*i* corresponding to the situation d, and letter f the set value with which the contact 24 is closed and which is selected at the intermediate value between the slip frequency commands c and e at the fixed speed of the cage 13 as illustrated in the figure.

Although the embodiment has been explained as to the case where the slip frequency command 17*i* and the predetermined value are compared in the overall section from the start to the stop of the cage, the comparison for the decision may well be made only when the speed command signal Vc is constant. In such a case, the time T of the time limit relay 25 is set shorter than in the embodiment in correspondence with noise environment and may well be shortened down to zero. On any occasion, the same effects as in the embodiment are achieved.

The embodiment has referred to the case where the contact 24 is opened when the slip frequency command 17*i* has exceeded the predetermined value. However, in a case where the speed controller 17*h* does not include an integral element for integrating the deviation between the speed command signal Vc and the speed signal Va, the contact 24 may well be opened when a signal obtained by amplifying the deviation signal has exceeded a predetermined value. This measure achieves the same effects as in the embodiment.

As described above, according to this invention, a control apparatus for an A.C. elevator is constructed so as to interrupt the feed of A.C power to an induction motor for driving a cage, upon detecting that a state in which a slip frequency command corresponding to the deviation between the speed signal of the induction motor and a preset speed command signal is greater than a predetermined set value continues in excess of a predetermined period of time. Therefore, the invention has the effects that the cage can be safely stopped when a brake is abnormal, and that the function of the brake is prevented from degrading.

What is claimed is:

1. A control apparatus for an A.C. elevator having a variable voltage and variable frequency inverter for driving an induction motor couple to a cage of the elevator, a control device for controlling the inverter in accordance with a deviation between a speed signal detected from the induction motor and a speed command signal having a preset value, and an abnormality detection device for interrupting feed of the A.C. power to said induction motor upon detecting that a slip frequency command corresponding to the deviation is greater than a predetermined set value and continues exceeding the predetermined set value in excess of a predetermined period of time.

2. A control apparatus for an A.C. elevator as defined in claim 1 wherein said predetermined period of time is set in correspondence with a nominal time interval in which the cage of the elevator reaches a fixed speed after starting.

3. A control apparatus for an A.C. elevator comprising:

an inverter for inverting D.C. power into A.C. power of variable voltage and variable frequency to drive an induction motor coupled to a cage of the elevator, a speed signal detector coupled to said induction motor for detecting a speed signal expressive of a rotating speed of said induction motor, an adder for comparing a speed command signal having a preset value and the speed signal from said speed signal detector so as to deliver a deviation signal, speed control means for correcting the deviation signal from said adder and delivering a slip frequency command equivalent to a torque command, delivering means for supplying controlling signals to said inverter on the basis of the slip frequency command from said speed control means and the speed signal from said speed signal detector, detection means for detecting that the slip frequency command from said speed control means is greater than a predetermined set value, time limit-detecting means for detecting that said detection means continues to produce a detected output in excess of a predetermined period of time, and abnormality detecting means for interrupting feed of the A.C. power to said induction motor in response to a detected output of said time limit-detecting means.

4. A control apparatus for an A.C. elevator as defined in claim 3 wherein the inverter control signal-delivering means delivers ignition signals for controlling said inverter.

5. A control apparatus for an A.C. elevator as defined in claim 4 wherein said delivering means comprises a voltage command generator connected to receive the slip frequency command and the speed signal from said speed signal detector for generating an A.C. voltage command, and a pulse width modulator for changing the generated A.C. voltage command into the ignition signals so as to control said inverter.

6. A control apparatus for an A.C. elevator as defined in claim 3 wherein said time limit-detecting means is a time limit relay.

7. A control apparatus for an A.C. elevator as defined in claim 6 wherein said time limit relay is connected in series with a contact which is closed when said detection means has operated.

8. A control apparatus for an A.C. elevator as defined in claim 3 wherein said abnormality detecting means interupts feed of the D.C. power to said inverter.

* * * * *